US011342680B2

(12) United States Patent
Ambe et al.

(10) Patent No.: US 11,342,680 B2
(45) Date of Patent: May 24, 2022

(54) ANTENNA DEVICE

(71) Applicant: YOKOWO CO., LTD., Tokyo (JP)

(72) Inventors: Tomio Ambe, Tomioka (JP); Atsushi Eika, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 145 days.

(21) Appl. No.: 16/962,865

(22) PCT Filed: Feb. 13, 2019

(86) PCT No.: PCT/JP2019/004979
§ 371 (c)(1),
(2) Date: Jul. 17, 2020

(87) PCT Pub. No.: WO2019/159924
PCT Pub. Date: Aug. 22, 2019

(65) Prior Publication Data

US 2020/0350688 A1 Nov. 5, 2020

(30) Foreign Application Priority Data

Feb. 13, 2018 (JP) ..... JP2018-023290

(51) Int. Cl.
*H01Q 13/10* (2006.01)
*H01Q 1/24* (2006.01)
(Continued)

(52) U.S. Cl.
CPC ..... *H01Q 13/10* (2013.01); *H01Q 1/243* (2013.01); *H01Q 1/32* (2013.01); *H01Q 1/38* (2013.01);
(Continued)

(58) Field of Classification Search
CPC ..... H01Q 13/10; H01Q 1/243; H01Q 1/32; H01Q 13/08; H01Q 21/26; H01Q 1/38; H01Q 1/48
See application file for complete search history.

(56) References Cited

U.S. PATENT DOCUMENTS 9,825,354 B2 11/2017 Hu et al.
2004/0257283 A1 12/2004 Asano et al.
(Continued)

FOREIGN PATENT DOCUMENTS

FR 3054940 A1 2/2018
JP 5-136627 A 6/1993
(Continued)

OTHER PUBLICATIONS

Notice of Reasons for Refusal dated Aug. 3, 2021 in Japanese Application No. 2018-023290.
(Continued)

*Primary Examiner* — Joseph J Lauture
(74) *Attorney, Agent, or Firm* — Xsensus LLP

(57) ABSTRACT

A novel small-sized low profile antenna device that replaces a monopole antenna is provided. The antenna device is attached to a vehicle, the vehicle has an attachment surface, and the antenna device includes plural metal surfaces provided on a plane generally orthogonal to the attachment surface, the plural metal surfaces being formed at different angles from each other. A section of the antenna device opposed to the attachment surface is open, and each of the metal surfaces is formed with at least either one of a slot antenna and a slit antenna for a vertically polarized wave.

16 Claims, 9 Drawing Sheets

(51) Int. Cl.

| | |
|---|---|
| ***H01Q 1/32*** | (2006.01) |
| ***H01Q 1/38*** | (2006.01) |
| ***H01Q 13/08*** | (2006.01) |
| *H01Q 21/26* | (2006.01) |
| *H01Q 1/48* | (2006.01) |

(52) U.S. Cl.
CPC ..... *H01Q 13/08* (2013.01); *H01Q 1/48* (2013.01); *H01Q 21/26* (2013.01)

(56) References Cited

U.S. PATENT DOCUMENTS

| | | | | |
|---|---|---|---|---|
| 2005/0099338 | A1 | 5/2005 | Noro et al. | |
| 2021/0013631 | A1* | 1/2021 | Jo ..... | H01Q 21/26 |

FOREIGN PATENT DOCUMENTS

| | | | |
|---|---|---|---|
| JP | 95-097117 | U | 12/1993 |
| JP | 10-200439 | A | 7/1998 |
| JP | 2002-135045 | A | 5/2002 |
| JP | 2004-023507 | A | 1/2004 |
| JP | 2004-242034 | A | 8/2004 |
| JP | 2005-142786 | A | 6/2005 |
| JP | 2006-527941 | A | 12/2006 |
| JP | 2010-081500 | A | 4/2010 |
| JP | 2014-082547 | A | 5/2014 |
| JP | 2016-504799 | A | 2/2016 |
| JP | 2017-204762 | A | 11/2017 |
| WO | 2004/112187 | A1 | 12/2004 |

OTHER PUBLICATIONS

International Search Report and Written Opinion dated Apr. 23, 2019 for PCT/JP2019/004979 filed on Feb. 13, 2019, 9 pages including English Translation of the International Search Report.
Extended European search report dated Oct. 14, 2021, in corresponding European patent Application No. 19753808.5, 8 pages.
Office Action dated Nov. 30, 2021, in corresponding Japanese patent Application No. 2020-079267, 6 pages.

* cited by examiner

ANTENNA DEVICE

CROSS-REFERENCE TO RELATED APPLICATIONS

The present application is based on PCT filing PCT/JP2019/004979, filed Feb. 13, 2019, which claims priority to JP 2018-023290, filed Feb. 13, 2018, the entire contents of each are incorporated herein by reference.

TECHNICAL FIELD

The present invention relates to a small-sized low profile antenna device for a vehicle.

BACKGROUND ART

In recent years, there has been a high demand for an antenna device that enables Long Term Evolution (LTE) communication and multiple-input multiple-output (MIMO) communication in a vehicle. The LTE communication is a communication form speeding up the third generation communication (3G). The MIMO communication is a communication form in which plural antennas are used, and different data are transmitted from the antennas and received by plural antennas simultaneously.

As an antenna device for the LTE communication, in the related art, an antenna device disclosed in Patent Literature 1 has been known. This antenna device includes plural antennas accommodated in a shark fin antenna housing with a length of 100 mm, a width of 50 mm, and a height of 45 mm, and one of the plural antennas is an unbalanced antenna that determines the height of the antenna device, in other words, a monopole antenna. Although not limited to the antenna device disclosed in Patent Literature 1, many antenna devices for vehicles use a monopole antenna because a vehicle roof is used as a ground plane.

PRIOR ART DOCUMENTS

Patent Literature

Patent Literature 1

National Publication of International Patent Application No. 2016-504799

SUMMARY OF INVENTION

Problems to be Solved by the Invention

An antenna device used for LTE communication or MIMO communication preferably has a high gain in the horizontal direction (a direction parallel with the ground) orthogonal to the zenith direction (a direction perpendicular to the ground). Further, there is a continuing demand for an antenna device for a vehicle to be small-sized and have a low profile. However, in a case where a monopole antenna is caused to have a low profile as in an antenna device disclosed in Patent Literature 1, degradation of a voltage standing wave ratio (VSWR) and lowering of a gain are incurred due to a decrease in the antenna size (height) in the zenith direction. In a case of a monopole antenna, implementing of a low profile is possible to some extent by satisfying a resonance condition by loading an antenna coil or the like, inserting an impedance matching circuit, and so forth. However, it is difficult to prevent degradation of the VSWR and lowering of the gain of an antenna itself. Further, in a case where MIMO communication is performed by an antenna device for a vehicle, size reduction is limited because plural antennas have to be installed.

An object of the present invention is to provide a novel small-sized low profile antenna device that replaces a monopole antenna.

Solution to the Problems

The present invention provides an antenna device to be mounted on a vehicle, wherein: the vehicle comprises an attachment surface: the antenna device comprises plural metal surfaces provided on a plane generally orthogonal to the attachment surface, wherein the plural metal surfaces are formed at different angles from each other; a section of the antenna device opposed to the attachment surface is open; and at least either one of a slot antenna and a slit antenna for a vertically polarized wave is formed on each of the metal surfaces.

Advantageous Effects of the Invention

In a case where a slot or a slit is used as an antenna element, a main polarized wave occurs in the direction orthogonal to the antenna element. Further, a high gain is exhibited in an opening direction of the slot or the slit (a direction generally vertical to a long side of the slot or the slit in a plane generally parallel with an attachment surface). In an antenna device of the present invention, because at least either one of a slot and a slit for a vertically polarized wave is formed in a metal surface, the gain in a vertically polarized wave in a direction parallel with the attachment surface may be enhanced even if the antenna device has a low profile. In addition, because plural metal surfaces are formed at different angles from each other, the opening direction of the slot or the slit may be made various directions. Consequently, the gain in the vertically polarized wave may be enhanced in various directions. In addition, in a case where a member or an antenna component related to the antenna device such as a circuit board is arranged in a section opposed to the attachment surface, the section opposed to the attachment surface is open. Consequently, change, repair, or the like of the member or the antenna component is easily performed compared to a case where the section opposed to the attachment surface is not open.

DESCRIPTION OF EMBODIMENTS

A description will hereinafter be made about examples of embodiments in which the present invention is applied to an antenna device for a vehicle capable of being used for LTE communication and reception of a satellite positioning system.

First Embodiment

Figure 1:
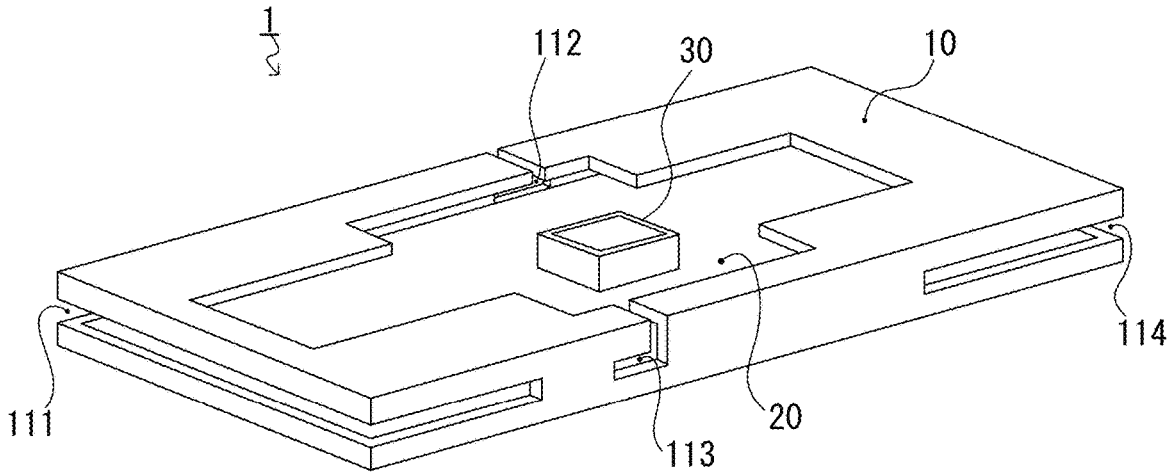
FIG. 1 is an external perspective view of an antenna device according to a first embodiment.

FIG. 1 is an external perspective view that illustrates a structure example of principal parts of an antenna device according to a first embodiment. This antenna device 1 has a casing and the casing 10 itself operates as an antenna for the LTE communication, an insulative circuit board 20 accommodated in a predetermined region of the casing 10, and a planar antenna 30 provided to the circuit board 20. Those are accommodated in a case formed of a material having electric wave permeability, for example, resin and are used while being fitted in a recessed surface of a vehicle roof, for example. The case is not shown in FIG. 1. The recessed surface of the vehicle roof will hereinafter be referred to as "attachment surface". In this embodiment, the planar antenna 30 is a patch antenna receiving an electric wave for a GNSS (global navigation satellite system) and is placed generally in parallel with the attachment surface. That is, the planar antenna 30 is configured such that a radiating element generally parallel with the attachment surface is formed in a top portion of an insulative dielectric body having a thickness. The circuit board 20 is equipped with antenna components including a connecting member with plural feeding points described later, an amplifier electrically connected with an electronic apparatus on the vehicle side, and so forth.

Figure 2A:
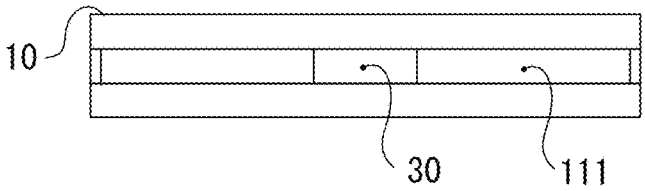
FIG. 2A is a diagram that illustrates a structure example of a first side surface of a casing.
Figure 2B:
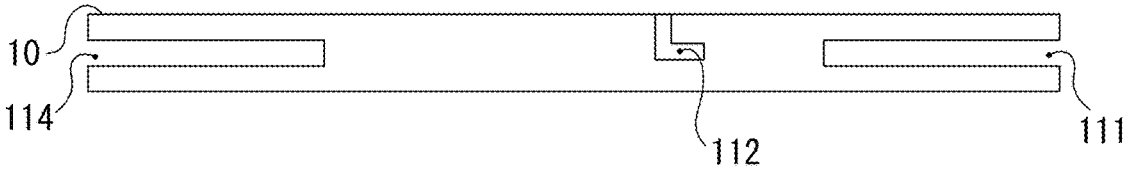
FIG. 2B is a diagram that illustrates a structure example of a second side surface of the casing.
Figure 2C:
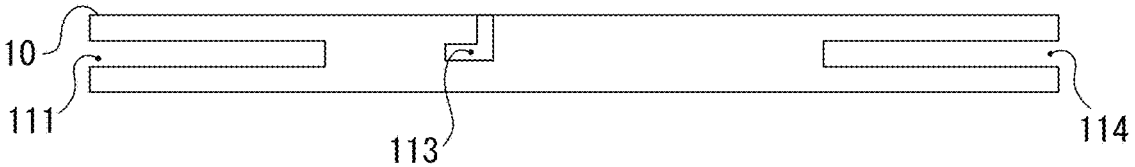
FIG. 2C is a diagram that illustrates a structure example of a third side surface of the casing.

The casing 10 is a box-shaped metal casing. In this embodiment, a generally rectangular column, which has a pair of short end surfaces and a pair of long end surfaces is used as a metal casing. The casing 10 may be supported by a holder formed of a resin. In this specification, in the casing 10, the whole short end surface on the left side of FIG. 1 will be referred to as "first side surface"; the whole other short end surface that may not be seen in FIG. 1 as "forth side surface"; the whole long end surface in front on the right side of FIG. 1 as "third side surface"; and the whole other long end surface that may not be seen in FIG. 1 as "second side surface". Further, a whole upper bottom surface of the casing 10 will be referred to as "top surface", and a lower bottom surface that may not be seen in FIG. 1 will be referred to as "bottom surface". The first side surface, the second side surface, the third side surface, and the fourth side surface stand on the bottom surface. FIG. 2A, FIG. 2B, FIG. 2C, and FIG. 2D are explanatory diagrams of the structure of the casing 10 that illustrate the first side surface, the second side surface, the third side surface, and the fourth side surface, respectively. FIG. 3A is an explanatory diagram of the structure of the casing 10 that illustrates the top surface opposed to the bottom surface, and FIG. 3B is an explanatory diagram of the structure of the casing 10 that illustrates the bottom surface.

The first side surface, the second side surface, the third side surface, and the fourth side surface are metal surfaces, and the first side surface to the fourth side surface form 90° with each other so as to surround a predetermined region where the planar antenna 30 is present. The first side surface to the fourth side surface are directed toward all bearings. Each of the first side surface, the second side surface, the third side surface, and the fourth side surface is generally orthogonal to the vehicle roof in placement on the attachment surface. The vehicle roof has a ground potential and has an area plural times the bottom surface of the casing 10 as if the vehicle roof were equivalent to the ground having an infinite area compared to the area of the bottom surface of the casing 10. Thus, the first side surface, the second side surface, the third side surface, and the fourth side surface may function as antenna elements having directivity to all bearings of 360° in the horizontal direction in the planes to which those side surfaces have directivity. The operation principles of those antenna elements will be described later.

The top surface and the bottom surface are also metal surfaces. The top surface and the bottom surface are surfaces opposed to the attachment surface, and a central portion of the top surface opens in a general cross shape. An opening section will be referred to as "opening", and the top surface other than the opening will be referred to as "partial surface". The planar antenna 30 is exposed in a substantially central portion of the opening. Thus, the planar antenna 30 is less likely to be influenced by the casing 10 in reception of an electric wave for the GNSS. This effect will be described later. The opening is formed in the general cross shape for reducing the interference of the casing 10 with the planar antenna 30. However, the opening may be formed in another shape in accordance with the shape of the planar antenna 30. For example, an elliptical shape or a rectangular shape is possible. The whole bottom surface except an attachment mechanism 40 to the vehicle side is a metal surface.

Regarding the size of the casing 10, for example, the long sides of the top surface and the bottom surface are approximately 200 mm, the short sides are approximately 100 mm, and the thickness (the height of the first side surface, the second side surface, the third side surface, and the fourth side surface) is approximately 17 mm. The case is slightly larger than the casing 10 but has a height of approximately 20 mm or lower from the attachment surface.

A slot 111 is formed in the first side surface. As illustrated in FIG. 2A, the slot 111 is formed in parallel or generally in parallel with the attachment surface of the vehicle roof, and both slot ends are across the neighboring second side surface and third side surface. The slot 111 reaches the neighboring second side surface and third side surface in addition to the first side surface, and the width of the antenna device 1 (the width of the first side surface) may be made narrow compared to a case where the slot 111 is formed only in the first side surface. Further, because the attachment surface is the ground plane, the slot 111 operates as a slot antenna for a vertically polarized wave in operation. The frequency at which transmission and/or reception are possible may flexibly be determined in accordance with the position of the feeding point. In a case where a coaxial cable is used, for example, power feeding to the feeding point is performed by connecting a core wire with an upper periphery (an upper portion of an inner periphery) of the slot 111 and a grounding wire with a lower periphery (a lower attachment of the inner periphery) of the slot. This feeding point is provided in a section offset to either one of left or right from a central portion of the slot 111.

For example, it is assumed that the feeding point is provided in a position of the first side surface close to the third side surface in the slot 111. In this case, the slot 111 has a first slot end (a closed end of the second side surface) and a second slot end (a closed end of the third side surface) that face the feeding point from the respective opposite directions. The length from the first slot end to the feeding point is set to ½ of a wavelength (resonant length) $\lambda_L$ at which resonance occurs in a 700 MHz to 900 MHz band of low band (low frequency band: the same applies to the following) of the LTE. Further, the length from the second slot end to the feeding point is set to ½ of a wavelength (resonant length) $\lambda_H$ at which resonance occurs in a 1.7 GHz to 2.7 GHz band of high band (high frequency band: the same applies to the following) of the LTE. Accordingly, the slot 111 may be caused to operate as a slot antenna that resonates in all frequency bands of LTE bands and enables transmission and/or reception of a vertically polarized wave.

Frequencies that may be used in each frequency band have a certain range (width). Thus, wavelength or resonant length denote a wavelength or a resonant length in a certain range (width), with the center of the range (width) being the frequency to be used.

Figure 2D:
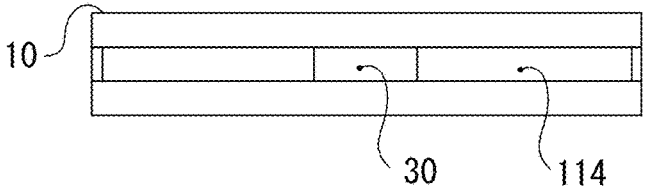
FIG. 2D is a diagram that illustrates a structure example of a fourth side surface of the casing.
Figure 3A:
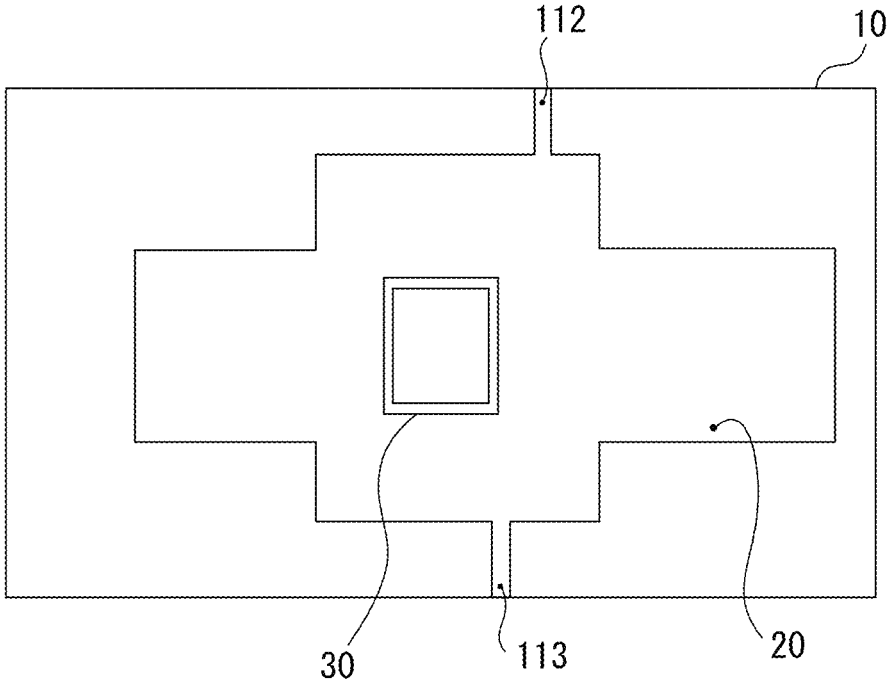
FIG. 3A is a top view of the casing.
Figure 3B:
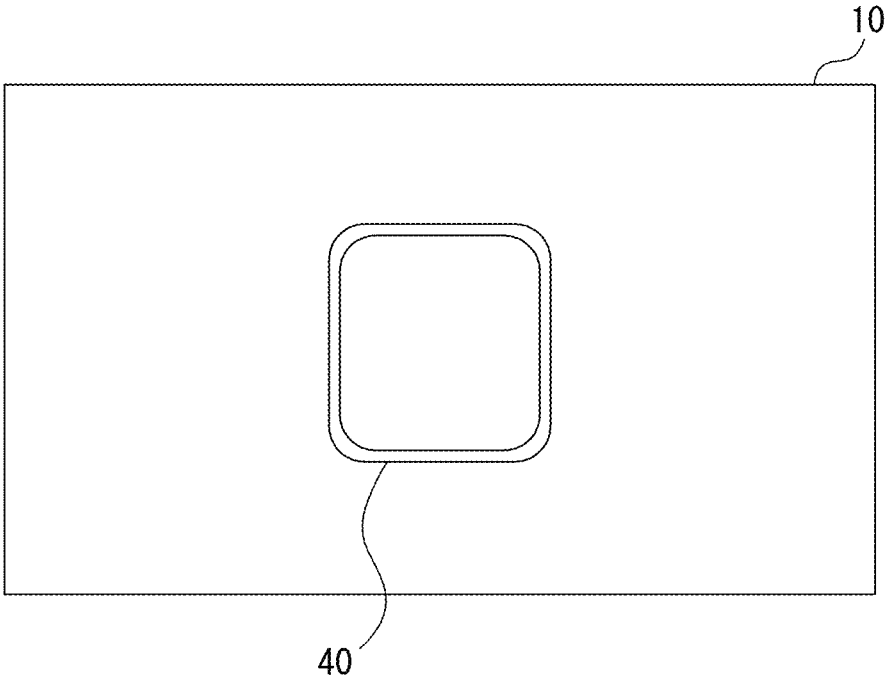
FIG. 3B is a bottom view of the casing.

As illustrated in FIG. 2D, a slot 114 has a similar structure to the slot 111. In other words, the slot 114 may be caused to operate as a slot antenna that resonates in all frequency bands of the LTE bands and enables transmission and/or reception of a vertically polarized wave. In this case, the feeding point is provided in the position (for example, an inner periphery of the slot corresponding to ½ of the wavelength (resonant length) $\lambda_L$ at which resonance occurs in the low frequency band of the LTE bands and to ½ of the wavelength (resonant length) $\lambda_H$ at which resonance occurs in the high frequency band of the LTE bands. The feeding points of the slot 111 and the slot 114 are provided in point-symmetric positions as seen from the top surface, in other words, in the most distant points from each other in the casing 10. Accordingly, the correlation between both of the slot 111 and the slot 114 is weakened, and mutual interference may be thereby reduced.

Main polarized waves are produced in the directions orthogonal to the slot 111 and the slot 114. Thus, the main polarized waves of those slot antennas are vertically polarized waves. In other words, in a case where the slot 111 and the slot 114 are parallel with the ground plate, the main polarized waves of those become vertically polarized waves. Further, the slot antennas exhibit high gains in the directions in which the surfaces in which the slot 111 and the slot 114 are formed are directed (opening directions of the slot 111 and the slot 114). Thus, in a slot antenna having those as principal elements, the gains in vertically polarized waves in the horizontal direction in which the surfaces in which the slot 111 and the slot 114 are thrilled are directed become relatively high. For example, in a case where the antenna device 1 is attached to the attachment surface with the first side surface directed to the front of the vehicle and with the fourth side surface directed to the rear of the vehicle, the slot 111 is formed to be directed to the front of the vehicle, and the slot 114 is formed to be directed to the rear of the vehicle. Thus, the gains of vertically polarized waves in the front-rear direction of the vehicle become relatively high. This tendency occurs in a similar manner in slit antennas described later. Thus, even if the attachment surface of the antenna device 1 is recessed from the vehicle roof, lowering of the gain is inhibited.

In this embodiment, the sizes of the slot 111 and the slot 114 and the positions of the feeding points in the inner peripheries of the slot 111 and the slot 114 are determined so as to enable transmission or reception of a signal in the low frequency band and the high frequency band of the LTE. In the following description, the slot 111 will be referred to as "LTE first antenna", and the slot 114 will be referred to as "LTE fourth antenna".

The LTE first antenna has a high gain in the vertically polarized wave in the horizontal direction in which the first side surface is directed. Thus, for example, the LTE first antenna may be caused to operate as a first antenna for 4×4 MIMO. Further, the LTE fourth antenna has a high gain in the vertically polarized wave in the horizontal direction in which the fourth side surface is directed. Thus, for example, the LTE fourth antenna may be caused to operate as a fourth antenna for the 4×4 MIMO.

Further, in this embodiment, a slit 112 and a slit 113 are formed in the second side surface and the third side surface, respectively, and those are caused to operate as slit antennas for the LTE.

As illustrated in FIG. 1 and FIG. 2B, as for the slit 112, an open end is formed in the top surface, and a closed end is formed in a position slightly shifted toward the slot 111 side from the middle portion between the slot 111 and the slot 114. Describing the second side surface, the slit 112 is formed by making a cut in a bottom surface direction from the top surface to a generally central portion of the thickness and then forming the closed end with a portion immediately close to a section where the direction of the cut is changed. The feeding point of the slit 112 is provided in a position shifted toward the closed end from a substantially middle portion between the section where the direction is changed and the closed end, for example. The length from the feeding point to a slit opening end is ¼ of the wavelength $\lambda_H$ of the high frequency band of the LTE.

In the following description, the slit 112 will be referred to as "LTE second antenna". The LTE second antenna has a high gain in the vertically polarized wave in the horizontal direction in which the second side surface is directed. Thus, for example, the LTE second antenna may be caused to operate as a second antenna in a 4×4 MIMO antenna.

As illustrated in FIG. 2C, the structure and the position of the feeding point of the slit 113 are similar to the slit 112. The slit 113 will be referred to as "LTE third antenna". The LTE third antenna has a high gain in the vertically polarized wave in the horizontal direction in which the third side surface is directed. Thus, for example, the LTE third antenna may be caused to operate as a third antenna in the 4×4 MIMO antenna.

All of the first side surface, the second side surface, the third surface, the fourth side surface, the top surface (partial surface), and the bottom surface are an integrated surface, and the respective metal areas around the slot 111 and the slot 114 and the slit 112 and the slit 113 may widely be secured. Thus, the band of frequencies at which transmission and/or reception are possible may be widened compared to a case where such a metal area may not be secured, and antenna efficiency is enhanced.

Further, the casing 10 is electrically connected with the attachment surface of the vehicle roof via the attachment mechanism 40, a whole vehicle body may be thereby used as metal around the slot 111 and the slot 114 and the slit 112 and the slit 113, and antenna performance may be improved compared to an interior of a free space. Further, even in a case where the antenna device 1 is arranged in a recess whose surroundings are metal, lowering of the VSWR or of the gain in the horizontal direction may be prevented, as compared to a monopole antenna in the related art, the monopole antenna disclosed in Patent Literature 1.

Figure 4:
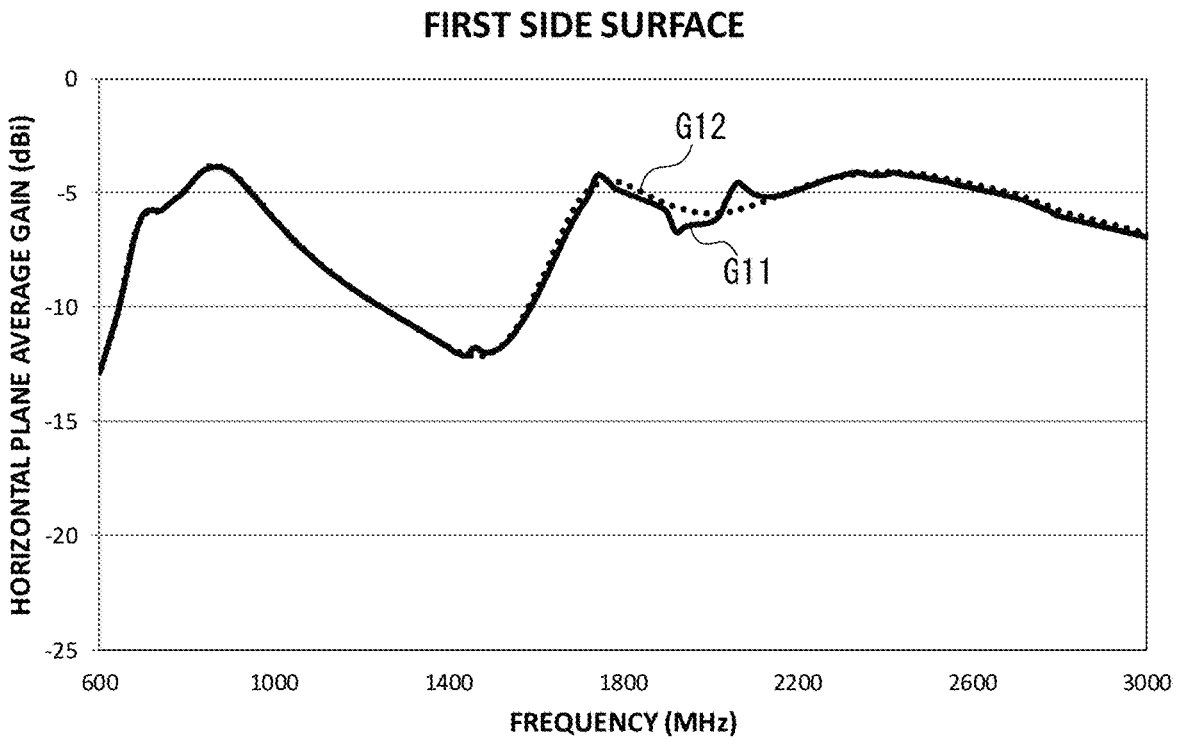
FIG. 4 is a graph of horizontal plane average gain characteristics of the first side surface of the casing about a vertically polarized wave in the horizontal direction.
Figure 5:
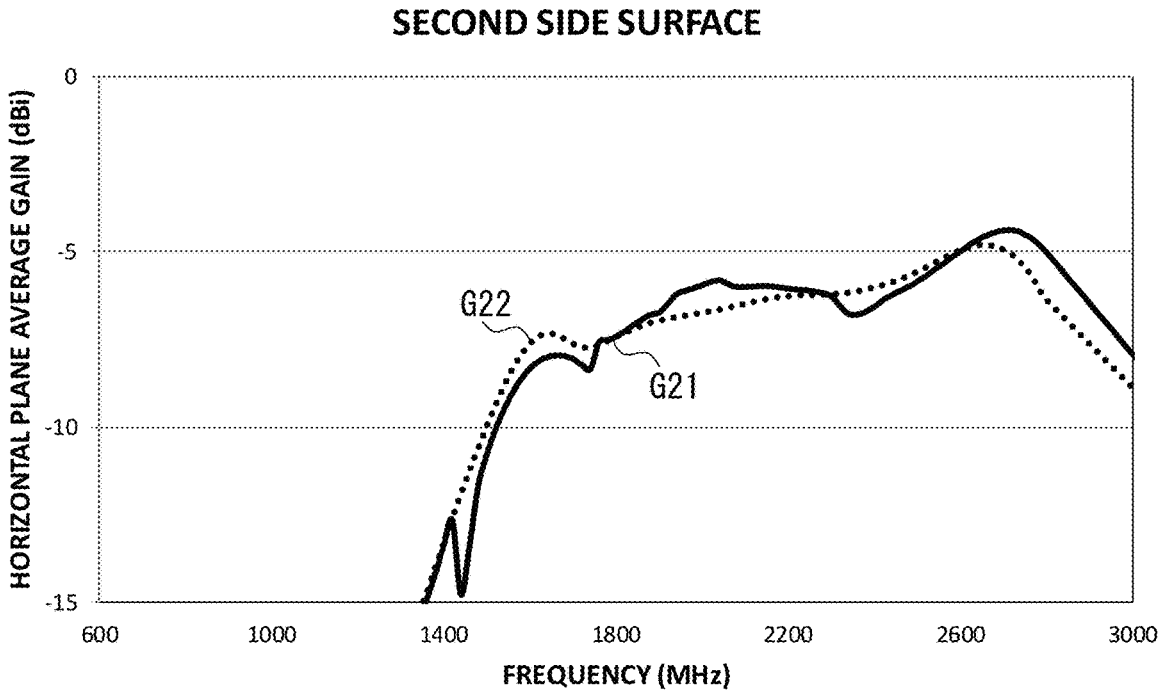
FIG. 5 is a graph of the horizontal plane average gain characteristics of the second side surface of the casing about the vertically polarized wave in the horizontal direction.
Figure 6:
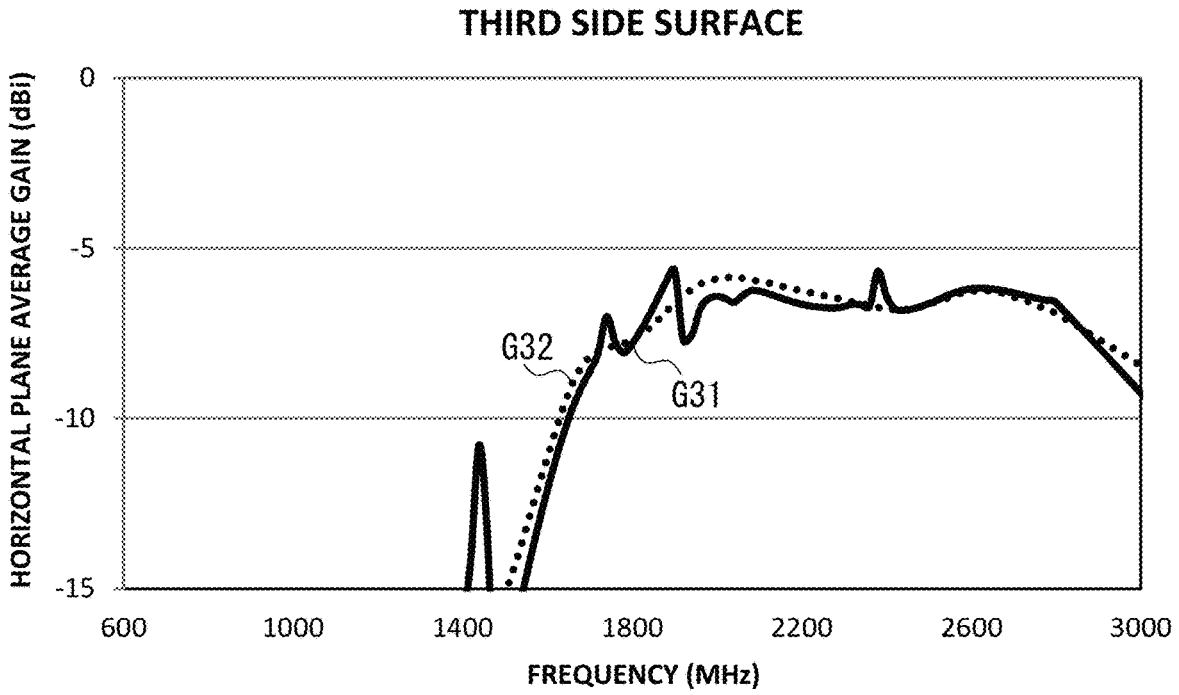
FIG. 6 is a graph of the horizontal plane average gain characteristics of the third side surface of the casing about the vertically polarized wave in the horizontal direction.
Figure 7:
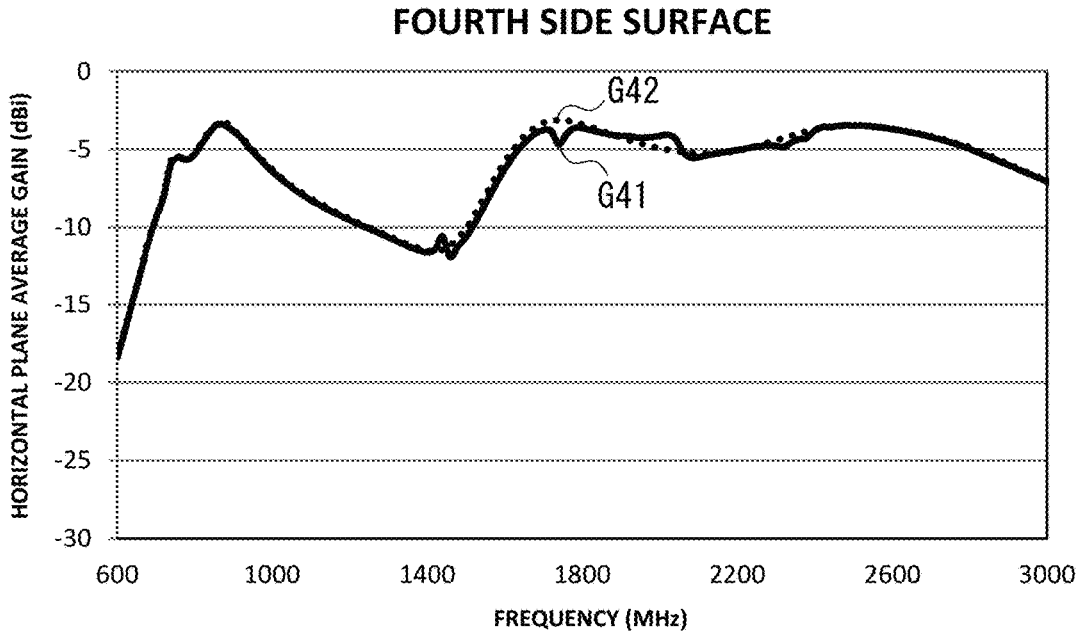
FIG. 7 is a graph of the horizontal plane average gain characteristics of the fourth side surface of the casing about the vertically polarized wave in the horizontal direction.

Next, a description will be made about antenna characteristics of the antenna device 1 of this embodiment. FIG. 4 is a graph that represents gain characteristics of the first side surface, FIG. 5 representing the gain characteristics of the second side surface, FIG. 6 representing the gain characteristics of the third side surface, and FIG. 7 representing the gain characteristics of the fourth side surface. In each of the graphs, the vertical axis represents a horizontal plane average gain (dBi), and the horizontal axis represents a frequency (MHz). Further, the solid lines in FIG. 4 to FIG. 7 indicate horizontal plane average gains G11, G21, G31, and G41 in a case where the planar antenna 30 is provided as illustrated in FIG. 1. The broken lines in FIG. 4 to FIG. 7 indicate horizontal plane average gains G12, G22, G32, and G42 in a case where the planar antenna 30 is detached from the circuit board 20. Based on FIG. 4 to FIG. 7, the horizontal plane average gains G11 and G41 of the respective slot antennas of the first side surface and the fourth side surface and the horizontal plane average gains G21 and G31 of the respective slit antennas of the second side surface and the third side surface do not largely change even if the planar antenna 30 is placed or detached. In other words, the four antennas for the LTE covering all bearings in a horizontal plane and the planar antenna 30 for the GNSS may be packaged together in one casing 10 without interference.

Further, the horizontal plane average gains G11, G21, G31, and G41 of the slot antennas and the slit antennas are scarcely different from the average gains of a shark fin antenna disclosed in Patent Literature 1 with a length of 100 mm, a width of 50 mm, and a height of 45 mm, and even frequency bands in which the horizontal plane average gains of the antenna device 1 of this embodiment are higher are present. The antenna device 1 of this embodiment has a height of 17 mm and thus has an advantage of having a lower profile with substantially the same antenna characteristics compared to an antenna device in the related art.

Figure 8:
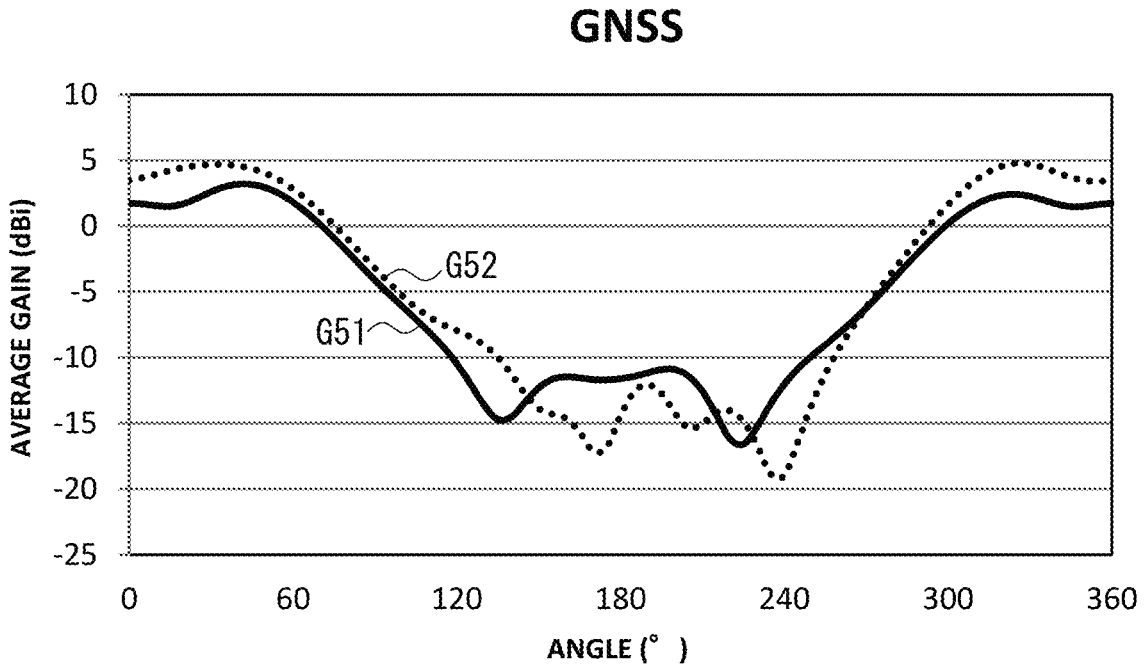
FIG. 8 is a graph of average gain characteristics of a planar antenna in a frequency band of a GNSS.

FIG. 8 is a graph that represents the gain characteristics of the planar antenna 30 in the frequency band of the GNSS, the vertical axis represents an average gain (dBi), and the horizontal axis represents an angle (°). The solid line indicates an average gain G51 of the planar antenna 30 in a case where the casing 10 is present, and the broken line indicates an average gain G52 of the planar antenna 30 in a case where the casing 10 is detached. Each of the average gains is the average gain in a case where the planar antenna 30 is attached to an attachment section of the vehicle roof having a recess. Angles of 0° and 360° correspond to the direction from the dielectric body of the planar antenna 30 to a radiating element of the top portion, that is, the zenith direction of the vehicle body in a case where the antenna device 1 is placed on the attachment section of the vehicle roof. Angles of 120° to 240° correspond to the direction from a side wall of the attachment section of the vehicle roof having the recess to the attachment surface. It may be understood from FIG. 8 that the average gain G51 of the planar antenna 30 does not make much difference even if the planar antenna 30 is placed in the slot antennas and the slit antennas.

As described above, in the first embodiment, because a main polarized wave occurs in the direction orthogonal to the slot 111 and the slot 114 and the slit 112 and the slit 113, the gain in the vertically polarized wave may be maintained even in a case where the casing 10 is caused to have a low profile of approximately 17 mm. In addition, the gain in the vertically polarized wave in the opening directions of the slot 111 and the slot 114 and the slit 112 and the slit 113, that is, the horizontal direction may be enhanced. Thus, the recess is provided in a portion of the vehicle roof, the antenna device 1 in the shape and size conforming to a surface of the recess is placed, and the antenna device 1 may be thereby provided so as not to protrude from the vehicle roof while the gain in all azimuths in the horizontal direction is secured. Consequently, the antenna device 1 may be made unrecognizable by external appearance. Accordingly, freedom of vehicle design may be enhanced, and effects may be provided which may not be obtained from this kind of antenna device in the related art in view of vehicle design.

In the first embodiment, a description is made about an example where each of the first side surface, the second side surface, the third side surface, and the fourth side surface becomes generally vertical to the attachment surface (ground plane) of the vehicle roof, however, the angles between those side surfaces and the attachment surface may arbitrarily set. As long as a relationship is provided in which each of the slot 111 and the slot 114 and the slit 112 and the slit 113 is parallel with the ground plane, the gain in the vertically polarized wave in the horizontal direction may be obtained. As long as each of the slot 111 and the slot 114 and the slit 112 and the slit 113 is directed in the horizontal direction, the gain in the vertically polarized wave in the horizontal direction may be obtained.

Further, in the first embodiment, a description is made about an example of a case where all of the bottom surface, the partial surface, and the first side surface to the fourth side surface are the integrated surface, configurations are not limited to this. A configuration is possible in which the bottom surface and at least one side surface; the partial surface and at least one side surface; at least two side surfaces; or the bottom surface, three side surfaces, and the partial surface are integrally formed. Accordingly, processing and mass production become easier than a case where all surfaces are physically separated, and cost reduction may be intended.

Modification Examples

Figure 9:
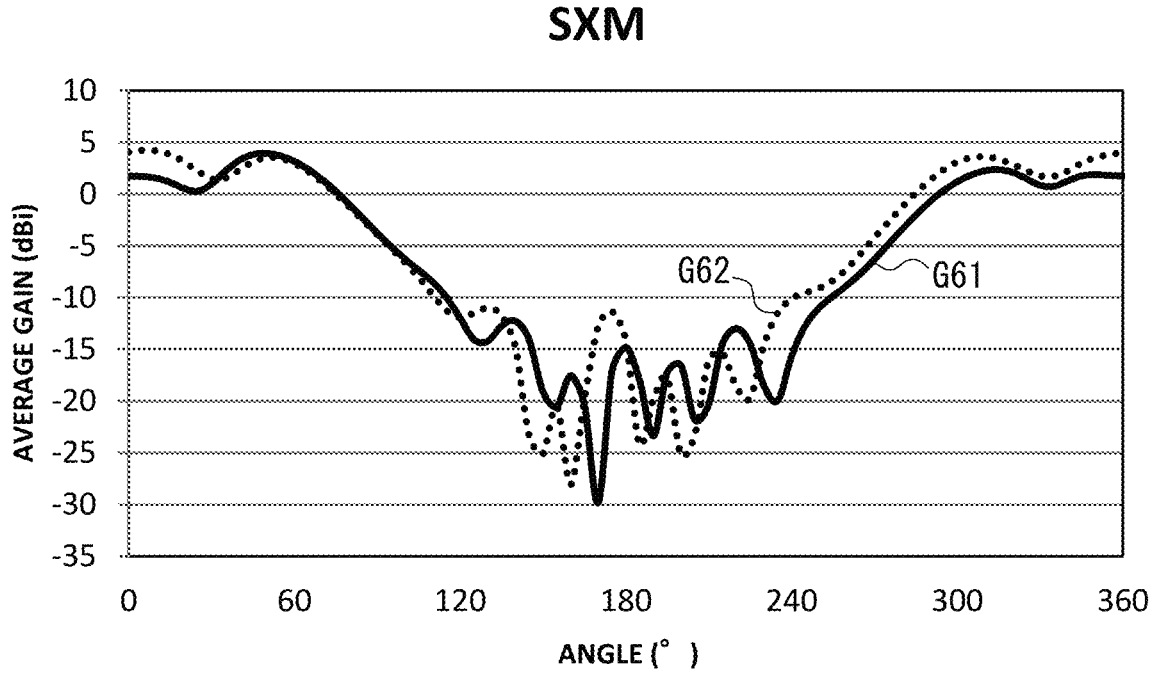
FIG. 9 is a graph of average gain characteristics of a planar antenna in a frequency band of SXM.

In the first embodiment, the planar antenna 30 is an antenna for the GNSS but may be made an antenna for SXM (Sirius XM) by using other artificial satellites. FIG. 9 is a graph that represents the gain characteristics of a planar antenna in the frequency band of SXM, the vertical axis represents an average gain (dBi), and the horizontal axis represents an angle (°). The solid line indicates an average gain G61 of the planar antenna in a case where the casing 10 is present, and the broken line indicates an average gain G62 of the planar antenna in a case where the casing 10 is detached. Each of the average gains is the average gain in a case where the planar antenna is attached to the attachment section of the vehicle roof having the recess. An angle of 0° and an angle of 360° correspond to the direction from the dielectric body of the planar antenna to the radiating element of the top portion. It may be understood from FIG. 9 that the average gain G61 does not largely change even if the planar antenna for SXM is placed in the slot antennas and the slit antennas.

Second Embodiment

Figure 10:
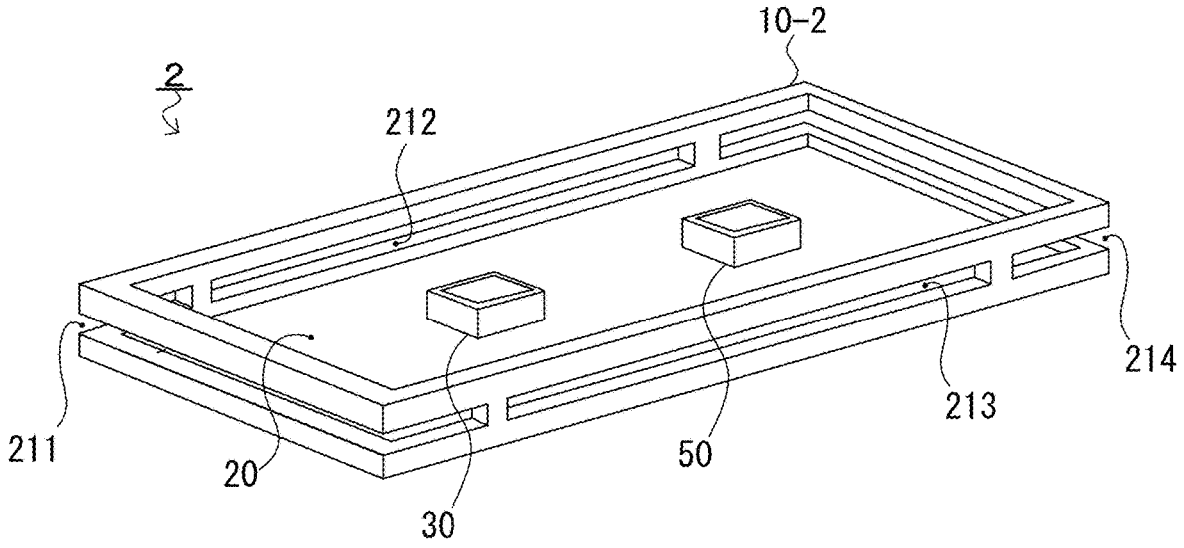
FIG. 10 is an external perspective view of an antenna device according to a second embodiment.

A second embodiment of the present invention will be described. The reference numerals are given to the same components as the first embodiment, and a description thereof will not be made. As illustrated in the external perspective view of FIG. 10, in an antenna device 2 of the second embodiment, the circuit board 20 is arranged in an interior of a box-shaped casing 10-2 in which at whole top surface is open, and the planar antenna 30 for the GNSS and a planar antenna 50 for SXM are side-by-side arranged on the circuit board 20 at a predetermined interval. The casing 10-2 in itself operates as an antenna, and the structure of a bottom surface is similar to the casing 10 of the first embodiment. Further, although an example will be described where the bottom surface and first side surface to fourth side surface are integrally formed, at least two side surfaces or the bottom surface and at least one side surface may be integrated together.

A slot 211 is formed in the first side surface of the casing 10-2 from the second side surface to the third side surface. The slot 211 has the same size as the slot 111 of the first embodiment. Thus, the feeding point is appropriately positioned, and the slot 211 may be caused to operate as a first antenna for the 4×4 MIMO that performs transmission and/or reception of an electric wave in all frequency bands of the LTE. A slot 214 is formed in the fourth side surface of the casing 10-2 from the second side surface to the third side surface. The slot 214 has the same size as the slot 114 of the first embodiment. Thus, the feeding point is appropriately positioned, and the slot 214 may be caused to operate as a fourth antenna for the 4×4 MIMO that performs transmission and/or reception of an electric wave in all frequency bands of the LTE.

Further, a slot 212 is formed in the second side surface of the casing 10-2 and a slot 213 is formed in the third side surface of the casing 10-2. The lengths and the positions of the feeding points of the slot 212 and the slot 213 are set to have the lengths and positions that enable transmission and/or reception in the high frequency band of the LTE, and the slot 212 and the slot 213 may be thereby caused to operate as a second antenna and a third antenna for the 4×4 MIMO that cover the high frequency band of the LTE. The antenna device 2 of the second embodiment has a main polarized wave in the direction orthogonal to the slot 211 to the slot 214. Thus, even in a case where the casing 10-2 is caused to have a low profile of approximately 17 mm, the gain in the vertically polarized wave may be maintained, and further the gain in the vertically polarized wave in the opening direction of each of the slot 211 to the slot 214, that is, in the horizontal direction may be enhanced.

The average gains of the planar antenna 30 and the planar antenna 50 are similar to the first embodiment. Because the planar antenna 30 and the planar antenna 50 are arranged side-by-side in the antenna device 2, the antenna device 2 may receive both of electric waves for the GNSS and SXM.

Third Embodiment

Figure 11:
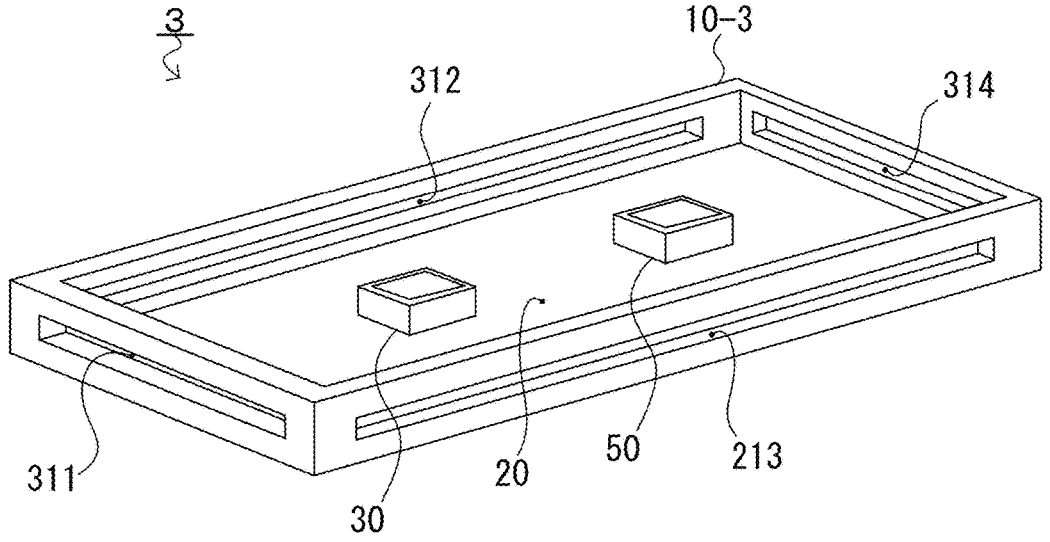
FIG. 11 is an external perspective view of an antenna device according to a third embodiment.

A third embodiment of the present invention will be described. As illustrated in the external perspective view of FIG. 11, in an antenna device 3 of the third embodiment, the circuit board 20 is arranged in an interior of a box-shaped casing 10-3 in which a top surface is open, and the planar antenna 30 for the GNSS and the planar antenna 50 for SXM are side-by-side arranged on the circuit board 20 at a predetermined interval. The casing 10-3 in itself operates as an antenna, and the structure of a bottom surface is similar to the casing 10 of the first embodiment. Further, although an example will be described where the bottom surface and first to fourth side surfaces are integrally formed, at least two side surfaces or the bottom surface and at least one side surface may be integrated together. It is clear from the graphs of gain characteristics of FIG. 8 and FIG. 9 that the average gains of the planar antenna 30 and the planar antenna 50 are not influenced because the top surface of the casing 10-3 is open.

Slot 311, slot 312, slot 313, and slot 314 are formed in the first side surface, the second side surface, the third side surface, and the fourth side surface, respectively, of the casing 10-3. The sizes and the positions of the feeding points of the slot 311 and the slot 314 are determined such that resonance occurs in the high frequency band of the LTE. Further, the sizes and the positions of the feeding points of the slot 312 and the slot 313 are determined such that resonance occurs in all frequency bands of the LTE.

Also in the antenna device 3 of the third embodiment, because a main polarized wave occurs in the direction orthogonal to the slot 311 to the slot 314, the gain in the vertically polarized wave may be maintained even if the casing 10-3 is caused to have a low profile of approximately 17 mm. In addition, the gain in the vertically polarized wave in the opening directions of the slot 311 to the slot 314, that is, the horizontal direction may be enhanced.

Fourth Embodiment

Figure 12:
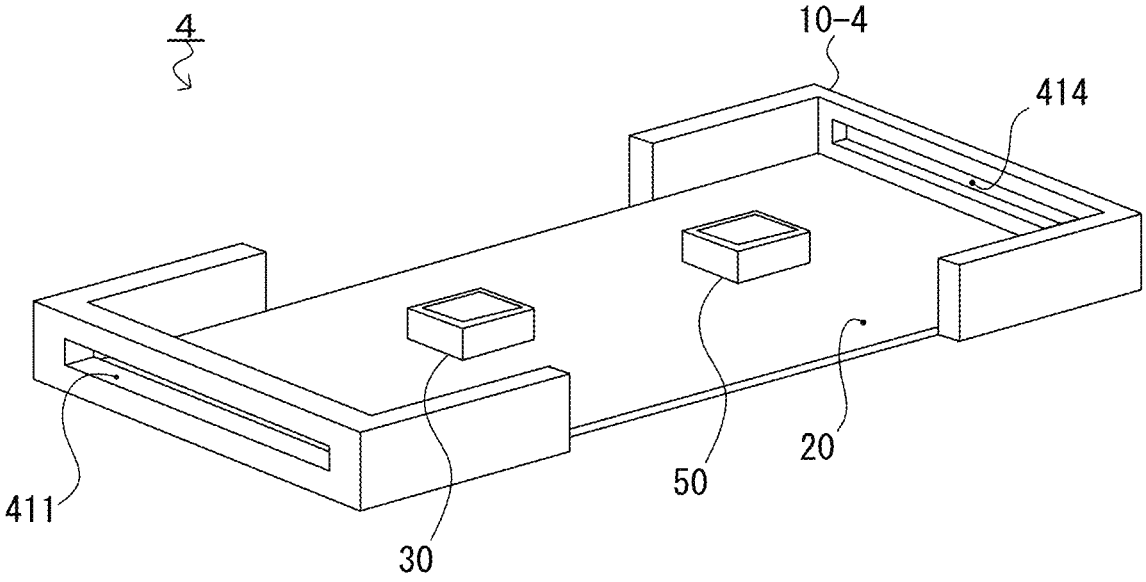
FIG. 12 is an external perspective view of an antenna device according to a fourth embodiment.

A fourth embodiment of the present invention will be described. As illustrated in the external perspective view of FIG. 12, an antenna device 4 of the fourth embodiment has a casing 10-4 having a structure in which the second side surface and the third side surface in the casing 10-3 of the antenna device 3 of the third embodiment are partially notched. The other configurations are similar to the antenna device 3. That is, among the first side surface, the second side surface, the third side surface, and the fourth side surface of the casing 10-4 of the antenna device 4, a slot 411 is formed in the first side surface, and a slot 414 is formed in the fourth side surface. The sizes and the positions of the feeding points of the slot 411 and the slot 414 are determined such that resonance occurs in the high frequency band of the LTE. In the fourth embodiment, although an example will be described where the bottom surface and the first side surface to the fourth side surface are integrally formed, configurations are not limited to this. For example, the first side surface, the second surface, and the third side surface, and the second surface, the third side surface, and the fourth side surface may be made a pair of side surfaces separated from each other.

Also in the antenna device 4 of the fourth embodiment, because a main polarized wave occurs in the direction orthogonal to the slot 411 and the slot 414, the gain in the vertically polarized wave may be maintained even in a case where the casing 10-4 is caused to have a low profile of approximately 17 mm. In addition, the gain in the vertically polarized wave in the opening directions of the slots 411 and the slot 414, that is, the horizontal direction may be enhanced. Because the second side surface and the third side surface are partially notched, the influence on the planar antennas 30 and 50 are reduced compared to the antenna devices 1, 2, and 3 of the first, second, and third embodiments.

Fifth Embodiment

Figure 13:
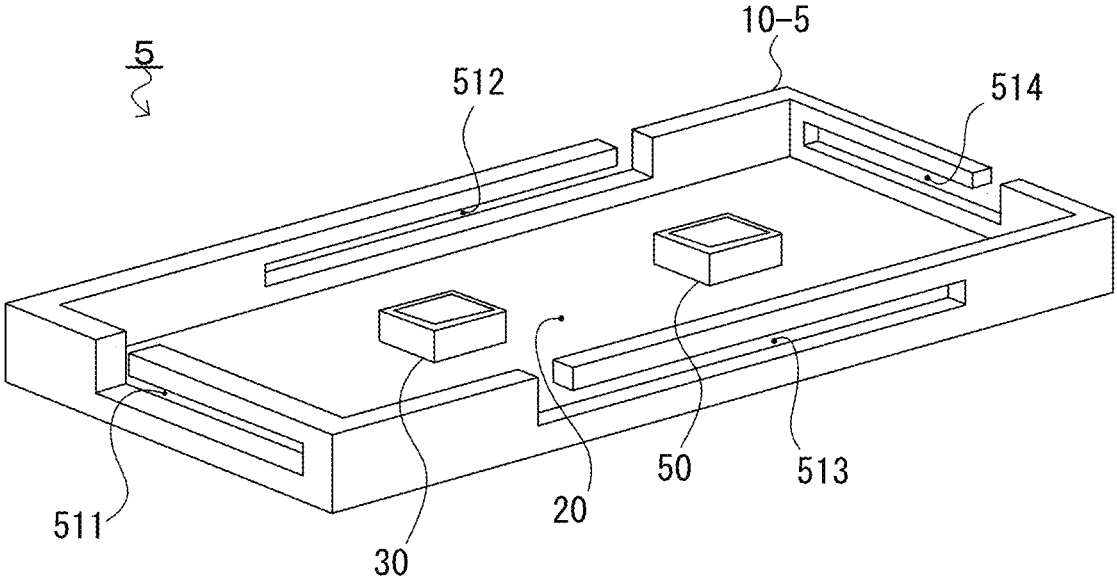
FIG. 13 is an external perspective view of an antenna device according to a fifth embodiment.

A fifth embodiment of the present invention will be described. As illustrated in the external perspective view of FIG. 13, in an antenna device 5 of the fifth embodiment, the circuit board 20 is arranged in an interior of a box-shaped casing 10-5 in which a top surface is open, and the planar antenna 30 for the GNSS and the planar antenna 50 for SXM are arranged on the circuit board 20 at a predetermined interval. The casing 10-5 in itself operates as an antenna, and the structure of a bottom surface is similar to the casing 10 of the first embodiment. Although an example will be described where the bottom surface and first side surface to fourth side surface are integrally formed, at least two side surfaces or the bottom surface and at least one side surface may be integrated together. Slit 511, slit 512, slit 513, and slit 514 are formed in the first side surface, the second side surface, the third side surface, and the fourth side surface, respectively, of the casing 10-5.

An open end of each of the slit 511 to the slit 514 is formed in a frame of the casing 10-5, and a closed end is formed in a position shifted toward a corner portion side of the other neighboring side surface.

In the first side surface, the slit 511 is formed by making a cut in a bottom surface direction from a short end frame of the casing 10-5 to a generally central portion of the thickness, then changing the direction of the cut toward the third side surface, and forming the closed end with a portion which the cut reaches. The feeding point for the slit 511 is provided in a position shifted toward the closed end from a substantially middle portion between the section where the direction is changed and the closed end, for example. The length from the feeding point to a slit opening end is ¼ of the wavelength $\lambda_H$ of the high frequency band of the LTE. The slit 514 of the fourth side surface has the same structure as the slit 511 of the first side surface.

In a case of the third side surface, the slit 513 is formed by making a cut in a bottom surface direction from a long end frame of the casing 10-5 to a generally central portion of the thickness, then changing the direction of the cut toward the fourth side surface, and forming the closed end with a portion which the cut reaches. The feeding point for the slit 513 is provided in a position shifted toward the closed end from a substantially middle portion between the section where the direction is changed and the closed end, for example. The length from the feeding point to a slit opening end is ¼ of the wavelength $\lambda_L$ of the low frequency band of the LTE. The slit 512 of the second side surface is similar to the slit 513 of the third side surface. Those slits 511 to slit 514 have a high gain in the vertically polarized wave in the horizontal direction in which each of the side surfaces is directed. Thus, for example, the slit 511 to the slit 514 may be caused to operate as first antenna to fourth antenna in the 4×4 MIMO antenna.

Sixth Embodiment

Figure 14:
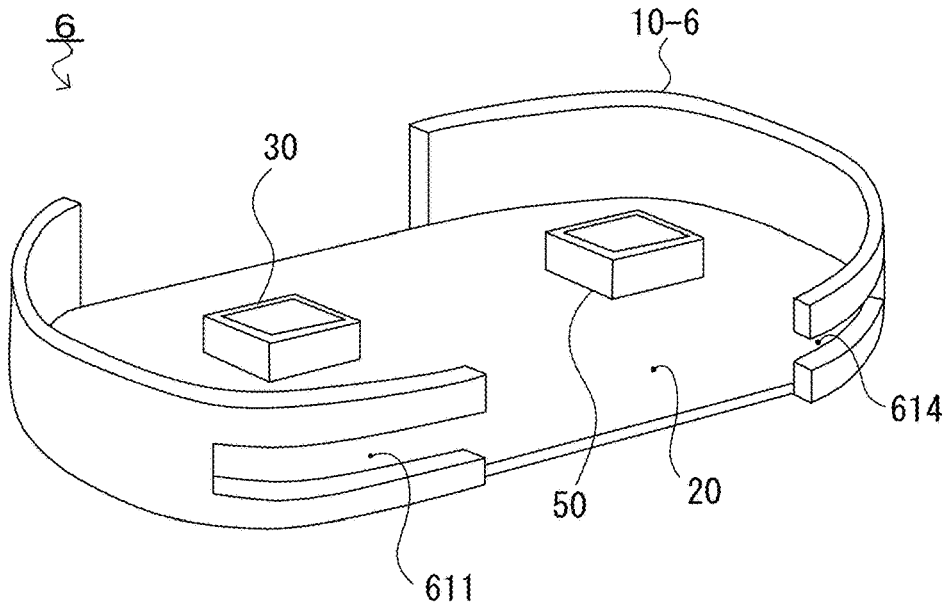
FIG. 14 is an external perspective view of an antenna device according to a sixth embodiment.

A sixth embodiment of the present invention will be described. As illustrated in the external perspective view of FIG. 14, an antenna device 6 of the sixth embodiment has a casing 10-6 in which the first side surface and the fourth side surface in the casing 10-4 of the antenna device 4 of the fourth embodiment are opposed to each other in curved shapes. A second side surface and a third side surface are partially notched. The circuit board 20 has a shape to be accommodated in the first side surface and the fourth side surface. A slit 611 is formed in the first side surface, and a slit 614 is formed in the fourth side surface. Although a bottom surface, the first side surface, and the fourth side surface are integrally formed, configurations are not limited to this. For example, the first side surface and the fourth side surface may be made a pair of side surfaces separated from each other.

In the slit 611, a portion of the first side surface of the casing 10-6, the portion in which a cut is made in parallel with the bottom surface and the attachment surface from a generally central portion in the height direction, becomes a closed end. The feeding point for the slit 611 is provided in a position shifted toward the closed end from a substantially middle portion between the section immediately close to a notch and the closed end, for example. The length from the feeding point to a slit opening end is ¼ of the wavelength $\lambda_H$ of the high frequency band of the LTE. The slit 614 of the fourth side surface has the same structure as the slit 611 of the first side surface.

Further, because the first side surface in which the slit 611 is formed and the fourth side surface in which the slit 614 is formed are opposed to each other in the curved shapes, mutual influences between the slits 611 and 614 may be reduced compared to a case where the curved shapes are not present.

Also in the antenna device 6 of the sixth embodiment, a main polarized wave occurs in the direction orthogonal to the slit 611 and the slit 614. Thus, even in a case where the casing 10-6 is caused to have a low profile of approximately 17 mm, the gain in the vertically polarized wave may be maintained, and further the gain in the vertically polarized wave in the opening directions of the slit 611 and the slit 614, that is, in the horizontal direction may be enhanced. Because the second side surface and the third side surface are partially notched, the influence on the planar antenna 30 and the planar antenna 50 are reduced compared to the antenna devices 1, 2, 3, and 5 of the first, second, third, and fifth embodiments.

Seventh Embodiment

Figure 15:
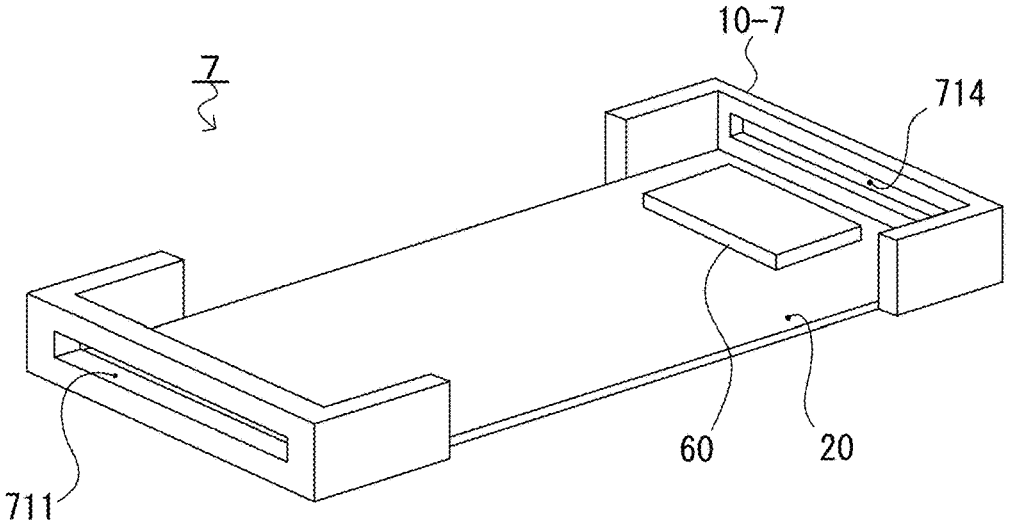
FIG. 15 is an external perspective view of an antenna device according to a seventh embodiment.

A seventh embodiment of the present invention will be described. As illustrated in the external perspective view of FIG. 15, an antenna device 7 of the seventh embodiment has a casing 10-7 having the same structure as the casing 10-4 of the antenna device 4 of the fourth embodiment. The casing 10-7 in itself also operates as an antenna, and the structure of a bottom surface and the circuit board 20 are similar to the antenna device 4. A slot 711 formed in a first side surface is similar to the slot 411 of the antenna device 4, and the slot 714 formed in a fourth side surface is similar to the slot 414 of the antenna device 4. Thus, the antenna characteristics, directivity, and so forth are similar to the antenna device 4. A different point is a point that a TCU (Telematics Communication Unit) 60 is arranged instead of the planar antenna 30 and the planar antenna 50 on the circuit board 20. The TCU 60 is a unit that establishes a communication path with a predetermined data center and receives convenient information for driving, charging, and so forth.

Eighth Embodiment

Figure 16A:
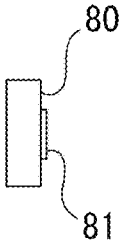
FIG. 16A is a diagram of a first side surface of an antenna device of an eighth embodiment.
Figure 16B:
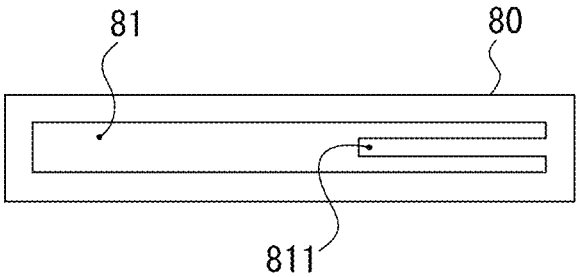
FIG. 16B is a front view of the antenna device of the eighth embodiment.
Figure 16C:
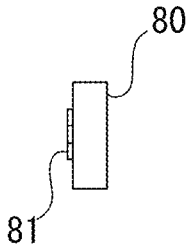
FIG. 16C is a diagram of a fourth side surface of the antenna device of the eighth embodiment.
Figure 16D:
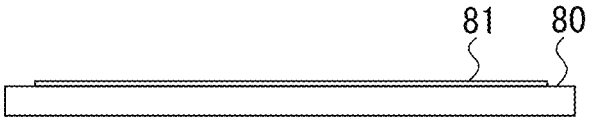
FIG. 16D is a lower surface view of the antenna device of the eighth embodiment.

An eighth embodiment of the present invention will be described. FIG. 16A is a diagram of a first side surface of an antenna device of the eighth embodiment, FIG. 168 is a front view, FIG. 16C is a diagram of a fourth side surface, and FIG. 16D is a lower surface view. In the antenna device 8, a slit 811 is formed of a metal film 81 on a surface of a plate body 80 formed of a resin, in other words, an insulator. The plate body 80 is vertically placed on the attachment surface. The length and the position of the feeding point of the slit 811 is determined such that resonance occurs in a used frequency band.

The antenna device 8 in such a configuration has a high gain in the vertically polarized wave in the horizontal direction in which the slit 811 is directed. Because the thickness of the plate body 80 and the length of a long side are adequate for a section to which the antenna device 8 is capable of being attached, the section is not necessarily limited to the vehicle roof but may be a side surface or the like of the vehicle body. Further, because a slit antenna may be realized only by adhering the metal film 81 to a resin, there is an advantage in cost.

In the first embodiment to the seventh embodiment, descriptions are made about examples where the metallic casing 10, and the metallic casing 10-2 to the metallic casing 10-7 themselves are caused to operate as slot antennas or slit antennas. However, those casing 10 and the casing 10-2 to the casing 10-7 may be configured with insulators, and the slot 111 and so forth or the slit 113 and so forth may be formed of metal films on their surfaces. This is more advantageous in cost.

Further, in the first embodiment to the eighth embodiment, descriptions are made on the assumption that the casing 10 and the casing 10-2 to the casing 10-7 and the plate body 80 are attached in parallel with the attachment surface on the vehicle roof as the ground plane and the ground. However, in a case where a metal plate having a ground plane may be provided to the vehicle vertically to the ground and the ground plane is closer than the ground, the slot 111 and so forth and the slit 113 and so forth may be formed vertically to the ground.

The invention claimed is:

1. An antenna device to be mounted on a vehicle, wherein:
- the vehicle comprises an attachment surface;
- the antenna device comprises plural metal surfaces provided on a plane generally orthogonal to the attachment surface, wherein the plural metal surfaces are formed at different angles from each other;
- a section of the antenna device opposed to the attachment surface is open; and
- at least either one of a slot antenna and a slit antenna for a vertically polarized wave is formed on each of the metal surfaces.

2. The antenna device according to claim 1, comprising:
- a metallic casing, the metallic casing itself is configured to form the slot antenna or the slit antenna,
- wherein the plural metallic surfaces are side surfaces of the casing, each of the side surfaces standing from a bottom surface of the casing so as to surround a predetermined region.

3. The antenna device according to claim 2, wherein:
- a partial surface other than the section being open in a top surface opposed to the bottom surface and at least one of the side surfaces are integrally formed;
- the bottom surface and at least one of the side surfaces are integrally formed;
- at least two of the side surfaces are integrally formed; or
- the bottom surface, at least one of the side surfaces, and the partial surface are integrally formed.

4. The antenna device according to claim 2, wherein:
- the side surfaces of the casing are plural side surfaces each having directivity in a generally horizontal direction to the attachment surface, wherein two or more side surfaces neighbor each other, and the slot antenna is formed across the two or more side surfaces neighboring each other.

5. The antenna device according to claim 2, wherein the side surfaces of the casing comprise a pair of metal surfaces opposed to each other so as to surround the predetermined region.

6. The antenna device according to claim 5, wherein respective central portions of the pair of metal surfaces are opposed to each other in curved shapes toward directions separating from a central portion of the predetermined region.

7. The antenna device according to claim 2, wherein:
- an antenna component electrically connected with the slot antenna or the slit antenna is provided in the predetermined region.

8. The antenna device according to claim 1, further comprising:
- a planar antenna arranged generally in parallel with the attachment surface, the planar antenna being exposed from the section being open.

9. The antenna device according to claim 8, wherein:
- the antenna device comprises two or more planar antennas, which are provided at a predetermined interval.

10. The antenna device according to claim 1, wherein at least one of the plural metal surfaces is formed on a surface of an insulator formed in a predetermined shape.

11. An antenna device for a vehicle to be mounted on the vehicle, comprising:
- a circuit board;
- at least a first antenna provided along an outer periphery of the circuit board; and
- at least a second antenna provided in a position toward inner side from the outer periphery of the circuit board, wherein:
- the first antenna resonates in one frequency band or a plurality of frequency bands,
- the second antenna receives a signal in a frequency band which is different from the frequency band of the first antenna, and
- the circuit board is equipped with connecting members with the corresponding feeding points of the first antenna and the second antenna, and is equipped with an electronic circuit to be electrically connected to an electronic device of the vehicle.

12. The antenna device for a vehicle according to claim 11, wherein:

the first antenna includes a metal surface, and the second antenna is provided in a position where the second antenna does not overlap the metal surface in a plan view.

13. The antenna device for a vehicle according to claim 11, wherein:

the first antenna includes at least a pair of metal surfaces, which are opposite each other with the second antenna therebetween, and the second antenna is provided in a position where the second antenna does not overlap any of the metal surfaces in a plan view.

14. The antenna device for a vehicle according to claim 11, wherein:

a direction in which a highest gain is obtained in the first antenna and a direction in which a highest gain is obtained in the second antenna are different from each other.

15. The antenna device for a vehicle according to claim 11, wherein:

the second antenna is a planar antenna or Telematics Communication Unit.

16. The antenna device for a vehicle according to claim 11, wherein the first antenna and the second antenna are provided within a recess formed in a roof of the vehicle.

* * * * *